US009709319B2

(12) United States Patent
Gultekin et al.

(10) Patent No.: US 9,709,319 B2
(45) Date of Patent: Jul. 18, 2017

(54) COOLING DEVICE COMPRISING A REAR WALL HAVING AN OUTER SURFACE PRODUCED FROM CELLULOSIC MATERIAL

(71) Applicant: Arcelik Anonim Sirketi, Istanbul (TR)

(72) Inventors: Ozgun Atac Gultekin, Istanbul (TR); Ahmet Kececi, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 14/354,837

(22) PCT Filed: Oct. 19, 2012

(86) PCT No.: PCT/EP2012/070780

§ 371 (c)(1),
(2) Date: Apr. 28, 2014

(87) PCT Pub. No.: WO2013/060629

PCT Pub. Date: May 2, 2013

(65) Prior Publication Data

US 2014/0299611 A1 Oct. 9, 2014

(30) Foreign Application Priority Data

Oct. 26, 2011 (TR) ..... a 2011 10673

(51) Int. Cl.
*F25D 23/00* (2006.01)
*F25D 23/06* (2006.01)
*B65D 81/38* (2006.01)

(52) U.S. Cl.
CPC ..... *F25D 23/065* (2013.01); *B65D 81/38* (2013.01)

(58) Field of Classification Search
CPC ..... F25D 2201/126; F25D 23/069; F25D 2201/128; F25D 23/066; F25D 23/085; F25D 23/062; E06B 3/66304
USPC ..... 220/592.02, 592.09, 592.05, 592.1, 220/592.06, 592.07; 62/DIG. 13; 428/158, 161, 304.4
See application file for complete search history.

(56) References Cited

U.S. PATENT DOCUMENTS 1,561,769 A * 11/1925 Ballew ..... 220/592.05
2,238,022 A * 4/1941 Johnson ..... 52/404.3
2,601,634 A 6/1952 Rivette
5,082,335 A * 1/1992 Cur ..... E04B 1/803 312/401
5,175,975 A * 1/1993 Benson et al. ..... 52/788.1
6,139,974 A * 10/2000 Atkinson et al. ..... 428/595
(Continued)

FOREIGN PATENT DOCUMENTS

EP 2133643 A2 12/2009
GB 1275744 A 5/1972

*Primary Examiner* — Shawn M Braden
(74) *Attorney, Agent, or Firm* — Kilpatrick Townsend & Stockton LLP

(57) ABSTRACT

The present invention relates to a cooling device (1) comprising a body (2) having a rear wall (3) having an inner surface (4), an outer surface (5) produced from cellulosic material and an insulation material (6) filled in the volume between the inner surface (4) and the outer surface (5), and wherein the insulation material (6) is prevented from forming deformations on the outer surface (5) during its solidification.

5 Claims, 3 Drawing Sheets

(56) References Cited

U.S. PATENT DOCUMENTS

Figure 1:
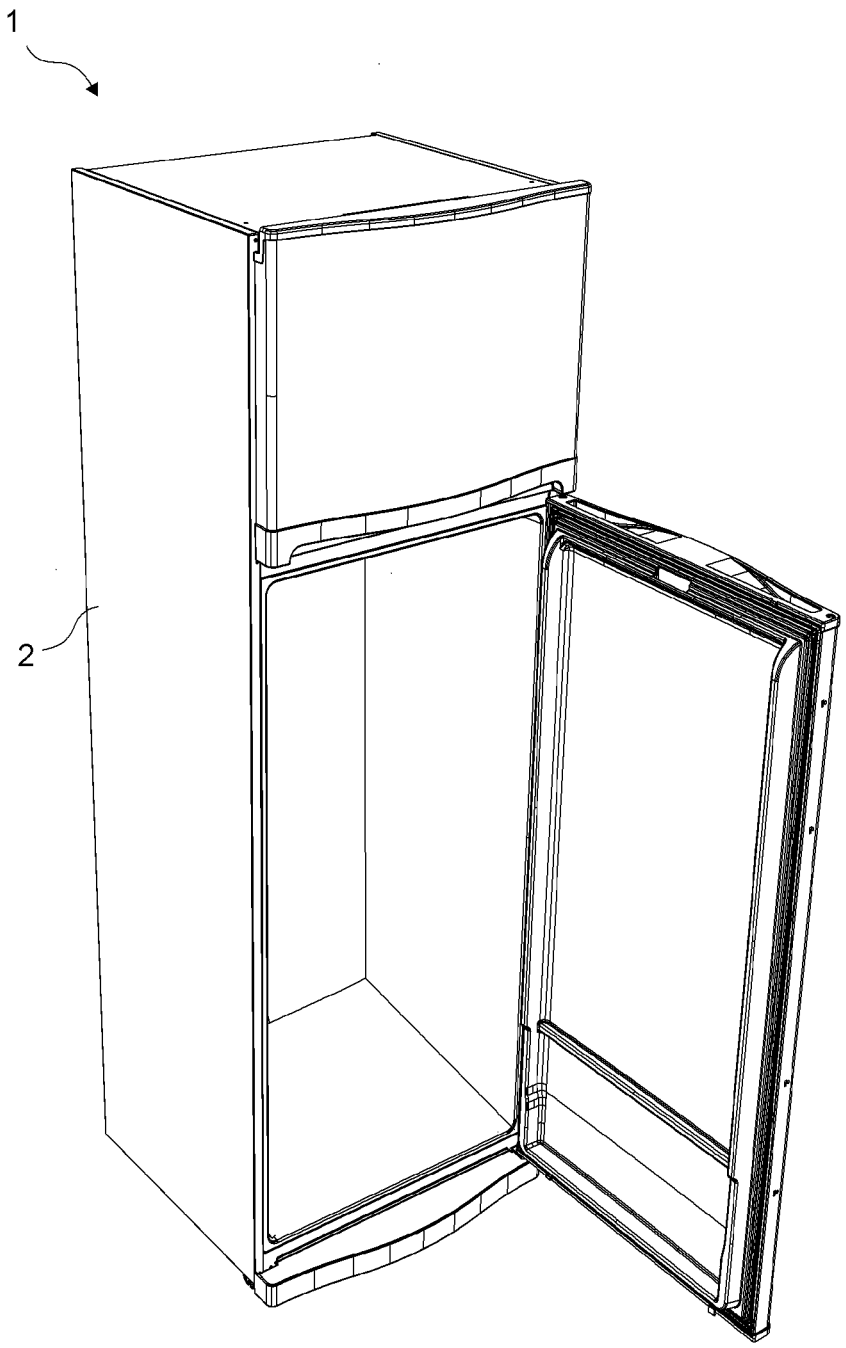

| | | | | |
|---|---|---|---|---|
| 6,479,112 | B1 * | 11/2002 | Shukuri | E06B 3/6612 156/109 |
| 7,559,343 | B1 * | 7/2009 | Vujic | F16L 59/12 138/148 |
| 2005/0200252 | A1 * | 9/2005 | Muller et al. | 312/401 |
| 2007/0180847 | A1 * | 8/2007 | Schabron | F25D 3/08 62/371 |

* cited by examiner

COOLING DEVICE COMPRISING A REAR WALL HAVING AN OUTER SURFACE PRODUCED FROM CELLULOSIC MATERIAL

The present invention relates to a cooling device comprising a rear wall having an outer surface produced from cellulosic material.

In cooling devices, especially in refrigerators and freezers, an insulation material is filled between the inner and outer surfaces of the body in order to provide heat insulation between the inner volume and the outer environment. Due to its chemical structure, the insulation material, that is preferably polyurethane, expands and solidifies once it is filled into the body of the cooling device. In some cooling devices, the outer surface of the rear wall which is not seen by the user is produced from cellulosic material such as paper, carton, cardboard, etc. In these cooling devices, the insulation material deforms the outer surface of the rear wall during its solidification. This situation causes the quality perception of the user to be decreased.

In the state of the art Korean Patent Application No. KR20070070066, a cooling device comprising a door having a metal frame is described. In this embodiment, the front panel of the door is produced from a material such as paper or like. In order to eliminate the deformations that may occur on the front panel of the door, a decorative panel is placed at the front side of the door so that the front panel and the decorative panel are spaced apart.

The aim of the present invention is the realization of a cooling device wherein deformations are prevented from occurring on the outer surface of the rear wall during the solidification of the insulation material.

The body of the cooling device realized in order to attain the aim of the present invention, explicated in the first claim and the respective claims thereof, comprises an inner surface, an outer surface and a rear wall having an insulation material filled in the volume between the said surfaces. Preferably polyurethane is used as the insulation material.

The cooling device furthermore comprises more than one protrusion placed in a pattern on the outer surface. The protrusions extend outwards from the outer surface. Thus, the volume between the inner surface and the outer surface increases, and since the insulation material expands in a larger volume, the pressure applied onto the inner and outer surfaces by the insulation material decreases. Moreover, the strength of the outer surface increases, thus preventing it from being deformed. The protrusions are positioned on the outer surface so as to form a texture. Preferably the protrusions are orderly arranged both transversely and longitudinally.

In an embodiment of the present invention, the protrusions form a grill-like structure on the outer surface. In this embodiment, the protrusions are arranged at equal intervals in the horizontal and the vertical directions. Thus, the outer surface can be rolled up to be stored and made ready by cutting before being placed on the rear wall of the cooling device. This provides the storage costs to be decreased.

In another embodiment of the present invention, at least the face of the outer surface visible to the user is coated with a material such as aluminum or like. Thus, the outer surface gains a metallic appearance and can be made matching with the other portions of the body when needed. Moreover, the aluminum layer increases the strength of the outer surface.

In another embodiment of the present invention, the protrusions are in cylindrical form. Thus, the durability of the outer surface is improved and the production thereof is eased.

By means of the present invention, the insulation material is prevented from causing formal deformations on the outer surface of the rear wall.

The cooling device realized in order to attain the aim of the present invention is illustrated in the attached figures, where:

FIG. 1—is the perspective view of a cooling device.

Figure 2:
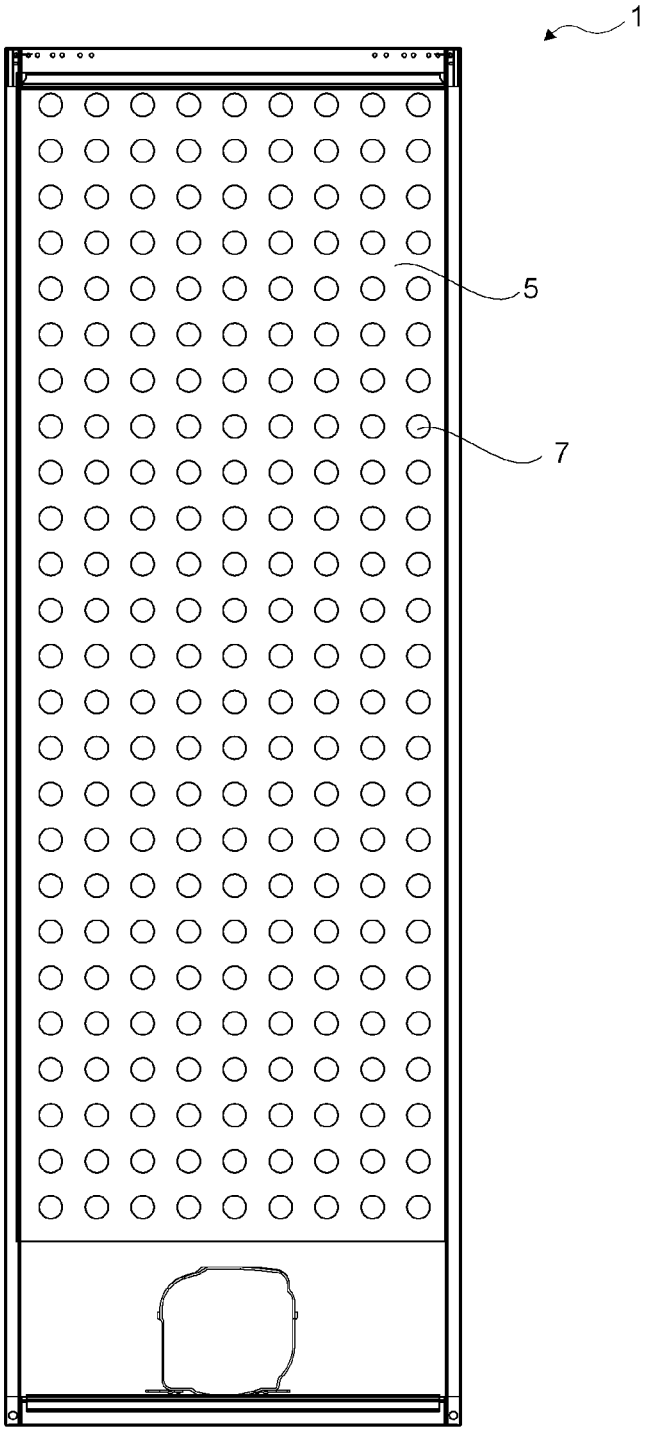

FIG. 2—is the rear view of the cooling device of the present invention.

Figure 3:
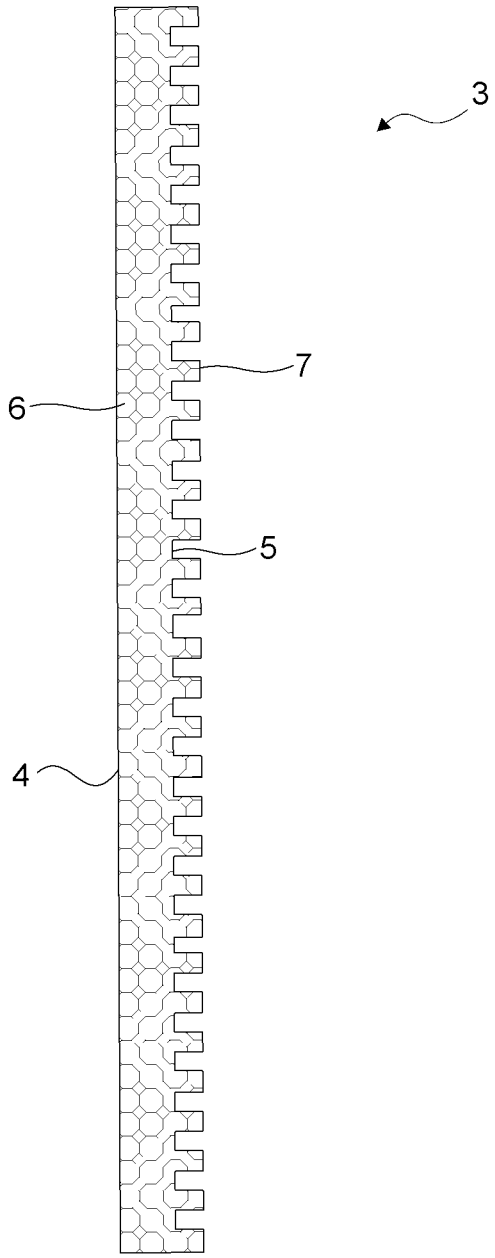

FIG. 3—is the schematic view of the rear wall.

The elements illustrated in the figures are numbered as follows:

1. Cooling device
2. Body
3. Rear wall
4. Inner surface
5. Outer surface
6. Insulation material
7. Protrusion The cooling device (1) comprises a rear wall (3) having an inner surface (4), an outer surface (5) produced from cellulosic material and an insulation material (6) filled in the volume between the inner surface (4) and the outer surface (5). The outer surface (5) is preferably produced from an approximately 2 mm thick carton. Thus, the outer surface (5) resists the pressure applied by the insulation material (6) during its solidification, thereby preventing the deformation of the structure of the rear wall (3) in form of a rectangular prism. Thus, the component cost of the outer surface (5) decreases (FIG. 1, FIG. 2, FIG. 3).

The cooling device (1) of the present invention comprises more than one protrusion (7) formed on the outer surface (5) at certain intervals. The protrusions (7) are regularly arranged in the horizontal and the vertical directions and do not disrupt the esthetic appearance of the outer surface (5). By means of the protrusions (7), the strength of the outer surface (5) is increased and the insulation material (6) is prevented from deforming the outer surface (5) during its solidification. Moreover, since the volume between the inner surface (4) and the outer surface (5) is expanded, the pressure applied by the insulation material (6) onto the surfaces (4, 5) is decreased (FIG. 2).

In an embodiment of the present invention, the protrusions (7) form a matrix that is located on the outer surface (5) so as to follow each other in the horizontal and the vertical directions and that covers almost the entire outer surface (5). This provides ease of production and also prevents the degradation of the visual integrity (FIG. 2).

In another embodiment of the present invention, at least the face of the outer surface (5) that does not contact the insulation material (6), is coated with a material such as aluminum or like. Thus, both the strength of the outer surface (5) is increased and also the esthetic appearance thereof is improved.

In another embodiment of the present invention, the cross-section of the protrusion (7) is in circular form. Thus, the amount of corner stress is decreased, providing increase in terms of strength (FIG. 2).

By means of the present invention, the component cost of the outer surface (5) is decreased and the insulation material (6) is prevented from causing formal deformations on the outer surface (5) during its solidification.

It is to be understood that the present invention is not limited to the embodiments disclosed above and a person skilled in the art can easily introduce different embodiments. These should be considered within the scope of the protection postulated by the claims of the present invention.

The invention claimed is:

1. A cooling device (1) comprising:

a body (2) having a rear wall (3), wherein the rear wall includes:

an inner surface (4), an outer surface (5) disposed opposite from the inner surface such that a volume is provided between the inner surface of the rear wall and the outer surface of the rear wall, wherein the inner surface and the outer surface are produced from cellulosic material, and an insulation material (6) provided in the volume between the inner surface of the rear wall and the outer surface of the rear wall, wherein the insulation material expands and solidifies upon filling the volume between the inner surface (4) and the outer surface (5), wherein the outer surface (5) of the rear wall has more than one protrusion (7) arranged at certain intervals on an external side of the outer surface (5) facing away from the insulation material, and wherein the protrusions (7) are located on the external side of the outer surface (5) to follow each other in the horizontal and the vertical directions so as to form a matrix that covers almost the entire outer surface (5).

2. The cooling device (1) as in claim 1, wherein the external side of the outer surface (5) is coated with aluminum.

3. The cooling device (1) as in claim 2, wherein at least one of the protrusions has a cross-section which is circular.

4. The cooling device (1) as in claim 1, wherein at least one of the protrusions has a cross-section which is circular.

5. A cooling device (1) comprising:

a body (2) having a rear wall (3), wherein the rear wall includes:

an inner surface (4), an outer surface (5) disposed opposite from the inner surface such that a volume is provided between the inner surface of the rear wall and the outer surface of the rear wall, wherein the inner surface and the outer surface are produced from cellulosic material, and an insulation material (6) provided in the volume between the inner surface of the rear wall and the outer surface of the rear wall, wherein the insulation material expands and solidifies upon filling the volume between the inner surface (4) and the outer surface (5), wherein the outer surface (5) of the rear wall has more than one protrusion (7) arranged at certain intervals on an external side of the outer surface (5) facing away from the insulation material, and wherein the protrusions (7) are located on the external side of the outer surface (5) to follow each other in the horizontal and the vertical directions so as to form a matrix that covers almost the entire outer surface (5), wherein at least one of the protrusions has a cross-section which is circular and wherein the external side of the outer surface (5) is coated.

* * * * *